US005508900A

United States Patent [19]

Norman

[11] Patent Number: 5,508,900

[45] Date of Patent: Apr. 16, 1996

[54] ILLUMINATED BICYCLE HELMET

[76] Inventor: Charles H. Norman, Rte. 3, Box 104-N, Gatesville, Tex. 76528

[21] Appl. No.: 311,394

[22] Filed: Sep. 23, 1994

[51] Int. Cl.[6] ..... A42B 3/04

[52] U.S. Cl. ..... 362/106; 362/157; 2/422

[58] Field of Search ..... 362/106, 157; 2/422, 425, 411; D2/869, 870, 872, 874; D29/102, 103

[56] References Cited

U.S. PATENT DOCUMENTS

| | | | |
|---|---|---|---|
| D. 316,165 | 4/1991 | Gentes et al. | 2/425 |
| D. 331,902 | 12/1992 | Greenlaw | D12/189 |
| D. 335,195 | 4/1993 | Choi et al. | 2/425 |
| D. 339,427 | 9/1993 | Gentes | 2/425 |
| 2,501,006 | 3/1950 | Rothchild | 362/106 |
| 3,963,917 | 6/1976 | Romano | 362/106 |
| 4,231,079 | 10/1980 | Heminover | 362/106 |
| 4,817,212 | 4/1989 | Benoit | 362/106 |
| 5,023,958 | 6/1991 | Rotzin | 2/425 |
| 5,327,587 | 7/1994 | Hurwitz | 2/422 |
| 5,329,637 | 7/1994 | Walker | 362/106 |

*Primary Examiner*—James C. Yeung
*Assistant Examiner*—Sara Sachie Raab

[57] ABSTRACT

A bicycle helmet for protecting the head and face of an individual and for alerting surrounding persons to a presence of such individual. The inventive device includes an exterior shell having a pair of signal lights mounted in a forward portion thereof. The signal lights can be selectively operated to attract attention of motor vehicle drivers or the like to a presence of the individual during nighttime conditions.

5 Claims, 4 Drawing Sheets

ILLUMINATED BICYCLE HELMET

BACKGROUND OF THE INVENTION

1. Field of the Invention

The present invention relates to helmet structures and more particularly pertains to a bicycle helmet for protecting the head and face of an individual and for alerting surrounding persons to a presence of such individual.

2. Description of the Prior Art

The use of helmet structures is known in the prior art. More specifically, helmet structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art helmet structures include U.S. Pat. No. 5,023,958; U.S. Pat. No. D339,427; U.S. Pat. No. D335,195; U.S. Pat. No. D331,902; and U.S. Pat. No. D316,165.

While these devices fulfill their respective, particular objectives and requirements, the aforementioned patents do not disclose an illuminated bicycle helmet which includes an exterior shell having at least one signal light mounted in a forward portion thereof, with the signal light being selectively operable to attract attention of motor vehicle drivers or the like to a presence of the individual during nighttime conditions.

In these respects, the illuminated bicycle helmet according to the present invention substantially departs from the conventional concepts and designs of the prior art, and in so doing provides an apparatus primarily developed for the purpose of protecting the head and face of an individual and alerting surrounding persons to a presence of such individual.

SUMMARY OF THE INVENTION

In view of the foregoing disadvantages inherent in the known types of helmet structures now present in the prior art, the present invention provides a new illuminated bicycle helmet construction wherein the same can be utilized for protecting the head and face of an individual and alerting motor vehicle drivers or the like to a presence of such individual during nighttime conditions. As such, the general purpose of the present invention, which will be described subsequently in greater detail, is to provide a new illuminated bicycle helmet apparatus and method which has many of the advantages of the helmet structures mentioned heretofore and many novel features that result in an illuminated bicycle helmet which is not anticipated, rendered obvious, suggested, or even implied by any of the prior art helmet structures, either alone or in any combination thereof.

To attain this, the present invention generally comprises a bicycle helmet for protecting the head and face of an individual and for alerting surrounding persons to a presence of such individual. The inventive device includes an exterior shell having a pair of signal lights mounted in a forward portion thereof. The signal lights can be selectively operated to attract attention of motor vehicle drivers or the like to a presence of the individual during nighttime conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated bicycle helmet apparatus and method which has many of the advantages of the helmet structures mentioned heretofore and many novel features that result in an illuminated bicycle helmet which is not anticipated, rendered obvious, suggested, or even implies by any of the prior art helmet structures, either alone or in any combination thereof.

It is another object of the present invention to provide a new illuminated bicycle helmet which may be easily and efficiently manufactures and marketed.

It is a further object of the present invention to provide a new illuminated bicycle helmet which is of a durable and reliable construction.

An even further object of the present invention is to provide a new illuminated bicycle helmet which is susceptible of a low cost of manufacture with regard to both materials and labor, and which accordingly is then susceptible of low prices of sale to the consuming public, thereby making such illuminated bicycle helmets economically available to the buying public.

Still yet another object of the present invention is to provide a new illuminated bicycle helmet which provides in the apparatuses and methods of the prior art some of the advantages thereof, while simultaneously overcoming some of the disadvantages normally associated therewith.

Still another object of the present invention is to provide a new illuminated bicycle helmet for protecting the head and face of an individual, and for alerting surrounding persons to a presence of such individual during nighttime conditions.

Yet another object of the present invention is to provide a new illuminated bicycle helmet which includes an exterior shell having at least one signal light mounted in a forward portion thereof, with the signal light being selectively operable to attract attention of motor vehicle drivers or other persons to a presence of the individual during nighttime conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
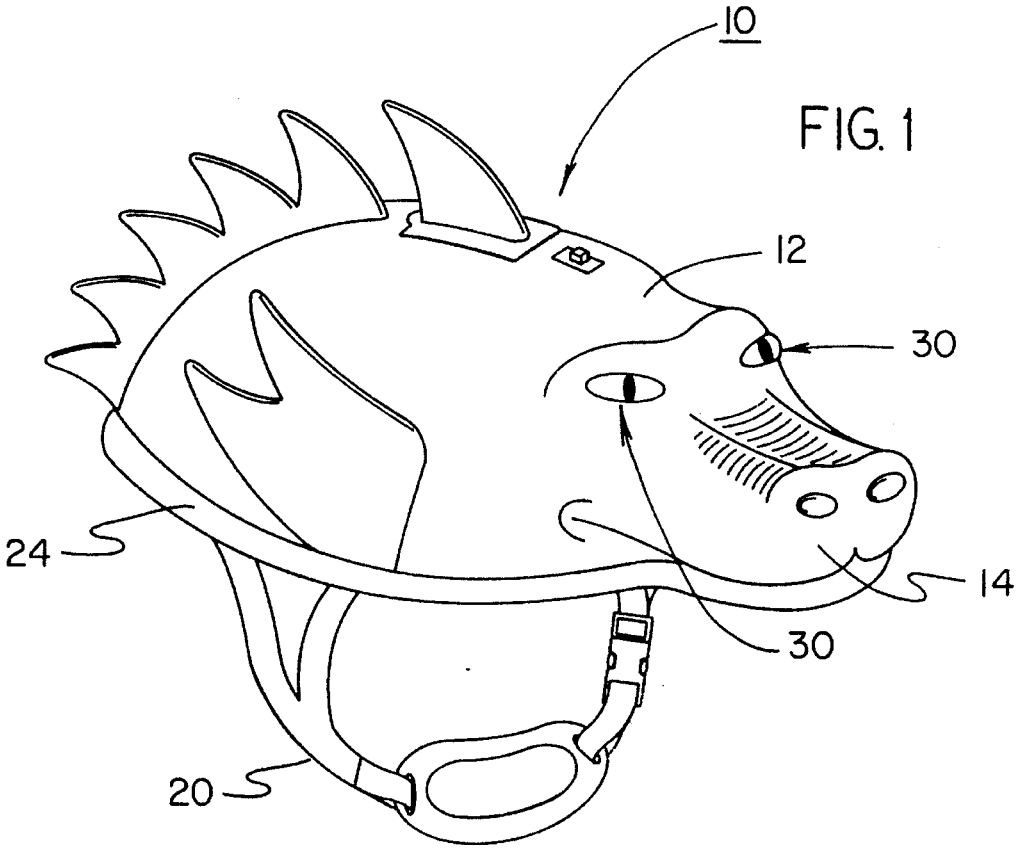
FIG. 1 is an isometric illustration of an illuminated bicycle helmet according to the present invention.

With reference now to the drawings, and in particular to FIGS. 1–8 thereof, a new illuminated bicycle helmet embodying the principles and concepts of the present invention and generally designated by the reference numeral 10 will be described.

Figure 2:
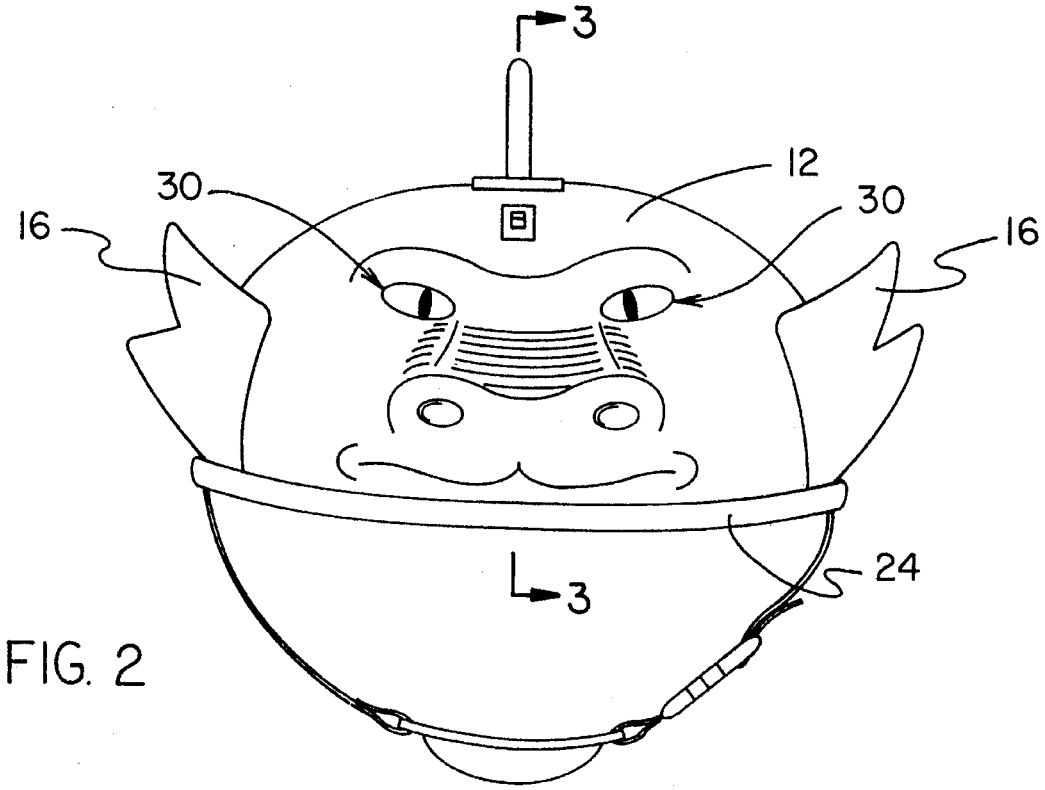
FIG. 2 is a front elevation view thereof.

More specifically, it will be noted that the illuminated bicycle helmet 10 comprises a contoured exterior shell 12 dimensioned to fit at least partially over the head of an individual wearing the helmet 10. The exterior shell 12 is substantially hemispherically shaped and includes a forwardly projecting visor 14, as best illustrated in FIGS. 1 and 2. The visor 14 serves both to shade an individual's eyes during use of the helmet 10, and further to protect an individual's face from impact with a ground surface during contact of the helmet therewith during an accident or the like. Preferably, the exterior shell 12 is shaped so as to resemble a head of a dragon, with the visor 14 being correspondingly shaped into the face of the dragon. However, it is within the intent and purview of the present invention to shape the exterior shell 12, including the projecting visor 14, into any one of a plurality of shapes. Such possible shapes of the exterior shell 12 and projecting visor 14 include, but are not limited to, a dinosaur head, a viking warrior head, a human skull representation, a monster head, a human brain representation, a rabbit or chipmunk head, a horse head, a pig head, a spaceman's helmet, or an insect head. For the purposes of discussion, the preferred embodiment of the exterior shell 12 and visor 14 being shaped as a dragon's head has been illustrated and is being described herein.

Figure 3:
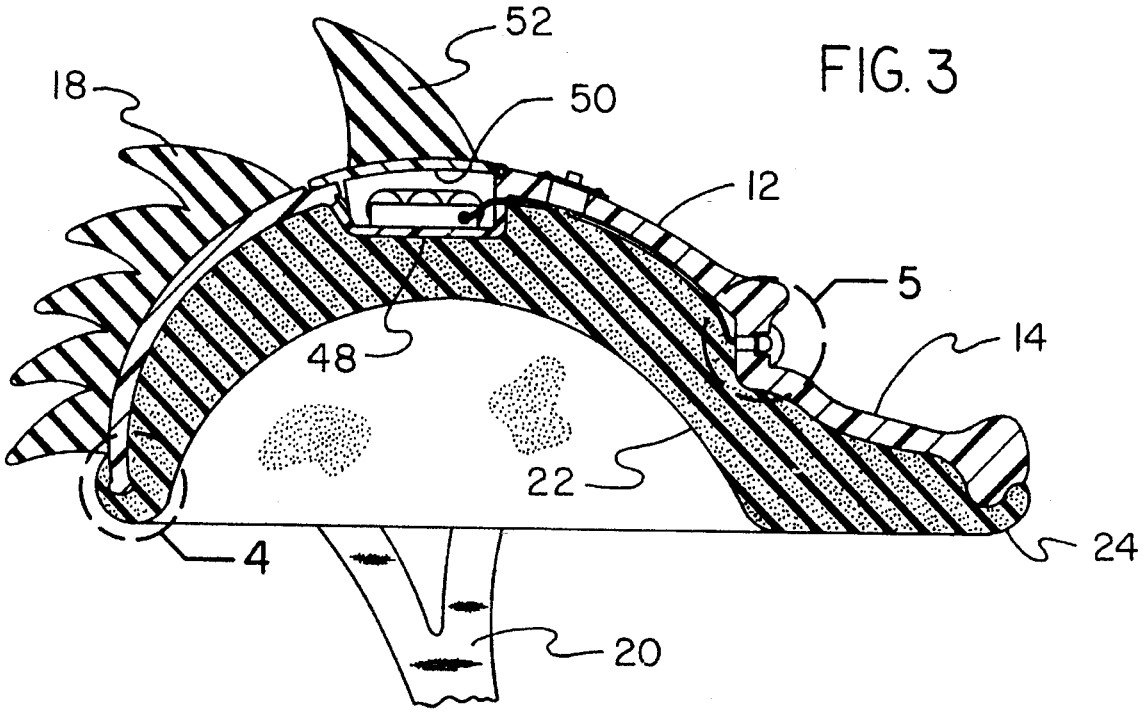
FIG. 3 is a cross-sectional view taken along line 3—3 of FIG. 2.

As shown in FIG. 2, a pair of lateral wind deflectors 16 are mounted to respectively opposed sides of the exterior shell 12 and serve both to ornament the dragon-like appearance of the device 10, as well as to deflect and agitate air currents passing thereover to improve cooling of an individual's head positioned within the device. Further, and as shown in FIG. 3, a center wind vane 18 longitudinally extends along an exterior surface of the shell 12 and serves to aerodynamically balance the individual's head against undesirable lateral movements thereof. To secure the device 10 to an individual, a strap means 20 extends from diametrically opposed sides of the exterior shell.

Figure 4:
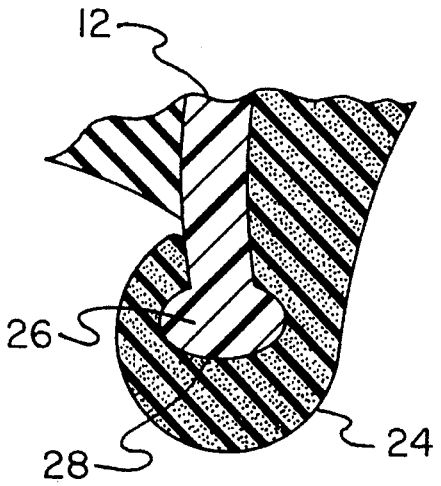
FIG. 4 is an enlarged view of the area set forth in FIG. 3.

Referring now to FIG. 3, it can be shown that the present invention 10 further comprises an interior pad 22 which coextensively covers an interior surface of the exterior shell 12. The interior pad 22 extends partially onto an exterior surface of the shell 12 to define a padded perimeter portion 24, with the perimeter portion 24 being operable both to pad the perimeter edge of the shell 12 and to removably couple the interior pad 22 within the shell 12. To this end, and as illustrated in FIG. 4, the perimeter of the exterior shell 12 is formed in such a manner so as to define an enlarged portion 26 which can be snapped into and frictionally retained within a cavity 28 formed within a perimeter portion 24 of the interior pad 22. By this structure, the interior pad 22 can be selectively removed from the shell 12 for washing or the like thereof.

Figure 5:
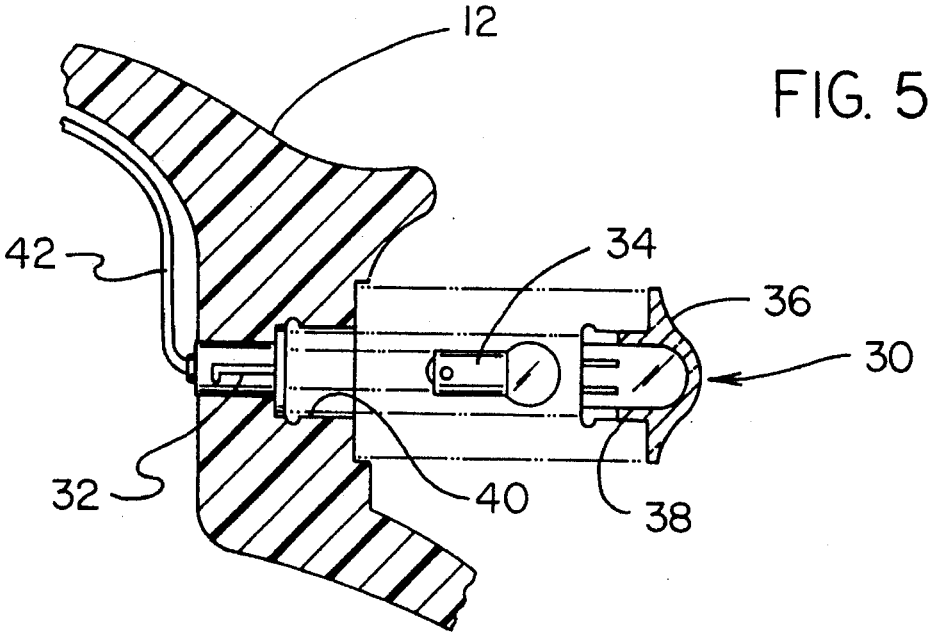
FIG. 5 is a further enlarged view of the area set forth in FIG. 3.
Figure 6:
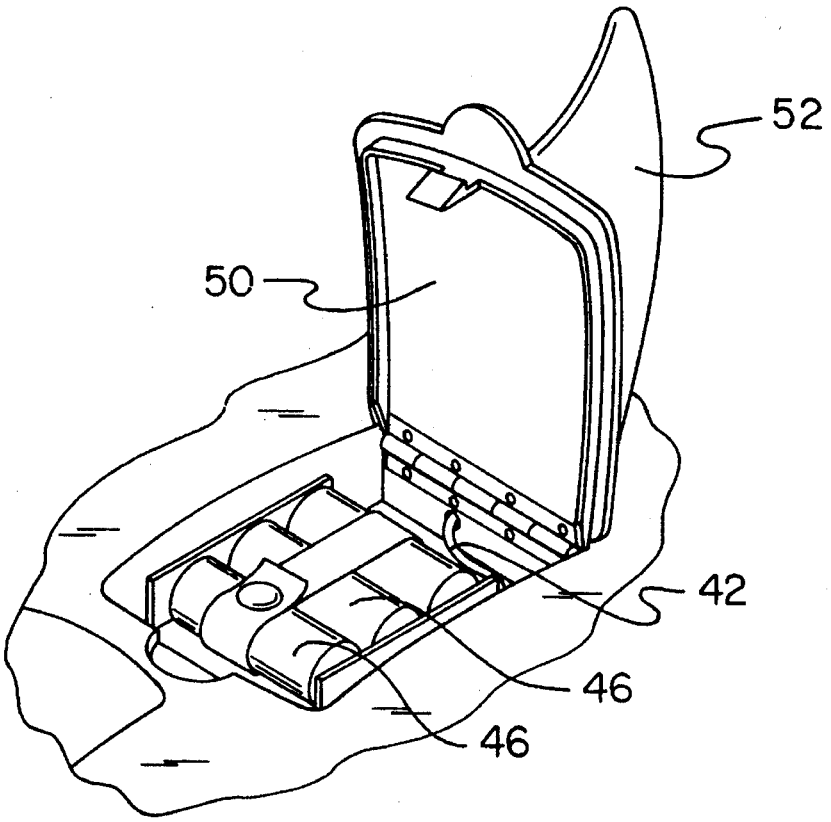
FIG. 6 is an enlarged isometric illustration of a portion of the present invention detailing a battery access door.

To alert surrounding individuals to a presence of an individual wearing the bicycle helmet 10, at least one signal light means 30 is secured to a front portion of the exterior shell 12. As shown in FIG. 5, the signal light means 30 preferably comprises a light socket 32 extending through the exterior shell 12 and receiving a light bulb 34 within the light socket. A lens 36, preferably constructed so as to resemble the eyes of the dragon (see FIG. 2) includes a cylindrical projection 38 which extends into a lens cavity 40 wherein the light bulb 34 is positioned when received within the light socket 32. The cylindrical projection 38 of the lens 36 includes an unlabelled annular projection which is received within an unlabelled annular groove within the lens cavity 40 to frictionally and removably retain the lens 36 relative to the exterior shell 12.

The light socket 32 is further operable to effect electrical connection between the light bulb 34 and a plurality of wires 42 extending therefrom through which electrical power may be communicated to the light bulb 34 to effect illumination or energization thereof. To this end, the light bulb 34 may comprise a continuous illuminating device, such as an incandescent direct current light bulb or an LED, or alternatively may comprise a flashing light, such as a flashing LED.

Figure 7:
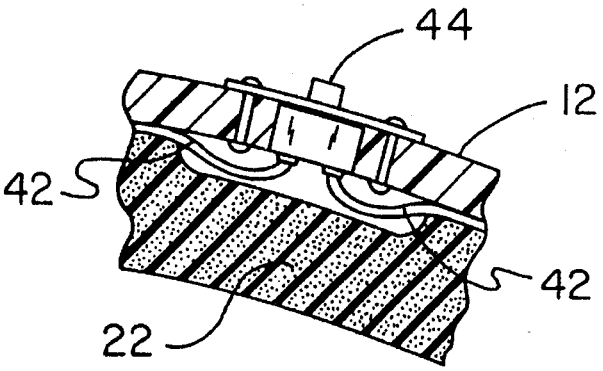
FIG. 7 is an enlarged cross-sectional view detailing a switch means of the present invention.

To effect selective energization of the light bulb 34 of the signal light means 30, a switch means 44 is electrically coupled to the plurality of wires 42, as shown in FIG. 7. The switch means 44 comprises a switch operable to electrically couple the wires 42 to a plurality of batteries 46. As best shown in FIG. 3, the exterior shell 12 is shaped so as to define a battery compartment 48 which receives the batteries 46 within an unlabelled battery tray having a plurality of contacts which couple the batteries to the wires 42. A battery access door 50 is pivotally mounted to the exterior shell 12 and operable to removably capture the batteries 46 within the battery compartment 48. An access door handle 52 is mounted to an exterior of the battery access door 50 and is operable to effect selective opening of the battery access door as desired. Preferably, the access door handle 52 is shaped so as to substantially resemble the center wind vane 18 and to provide a similar aerodynamic effect.

Figure 8:
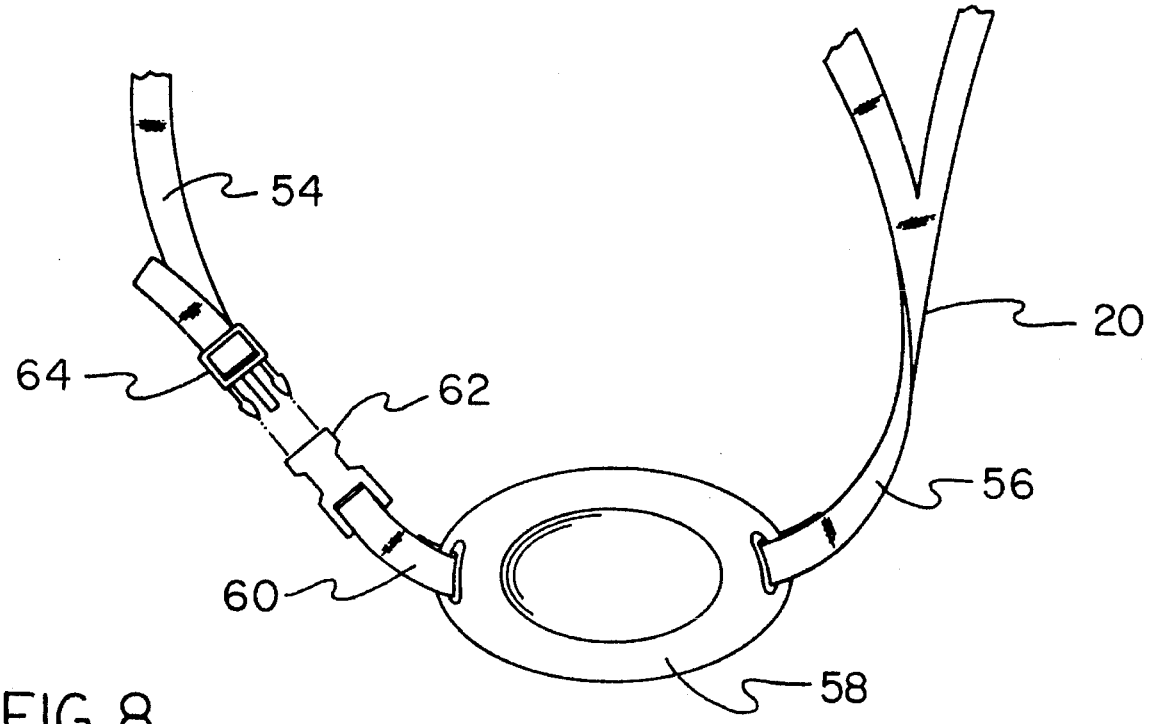
FIG. 8 is a front elevation view of the strap means of the present invention.

Referring now to FIG. 8, it can be shown that the strap means 20 for securing the illuminated bicycle helmet 10 to the head of an individual preferably comprises a first strap 54 secured to a first lateral edge of the exterior shell 12, and a second strap 56 secured to a second, opposed lateral edge of the shell. The second strap 56 extends from the shell to couple with a chin pad 58 engagable to the chin of an individual. A link strap 60 extends from an opposed side of the chin pad 58 relative to the second strap 56, and couples with a female clip 62 which may be selectively engaged to a male clip 64 secured to the first strap 54. The male clip 64 is adjustably coupled to the first strap 54 such that the strap means 20 can be tightened to securely couple the illuminated bicycle helmet 10 to the head of an individual.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated bicycle helmet comprising:

a contoured exterior shell for positioning at least partially over a head of an individual and wherein said exterior shell is substantially hemispherically shaped and includes a lens cavity formed therein, a battery compartment formed therein, a plurality of batteries removably disposed within the battery compartment, a battery access door pivotally mounted to said exterior shell and operable to removably capture said batteries within said battery compartment, and a forwardly projecting visor, said visor operating both to shade an individual's eyes during use of said helmet and to protect an individual's face from impact with a ground surface during contact of said helmet therewith;

an interior pad covering at least a portion of an interior surface of said exterior shell and wherein said interior pad extends partially onto an exterior surface of said shell to define a padded perimeter portion, with said perimeter portion being operable both to pad a perimeter edge of said shell and to removably couple said interior pad within said shell, said perimeter of said exterior shell being formed in such a manner so as to define an enlarged portion which can be snapped into and frictionally retained within a cavity formed within said padded perimeter portion of said interior pad and, signal light means coupled to the exterior shell for alerting surrounding individuals to a presence of said individual wearing said bicycle helmet and wherein said signal light means comprises a light socket extending through said exterior shell; a light bulb received within said light socket; a lens including a cylindrical projection which extends into said lens cavity said cylindrical projection of said lens including an annular projection received within an annular groove within said lens cavity to frictionally and removably retain said lens relative to said exterior shell; and switch means electrically coupled to said light socket for selectively coupling said light socket to said plurality of batteries.

2. The illuminated bicycle helmet of claim 1, and further comprising a pair of lateral wind deflectors mounted to respectively opposed sides of said exterior shell for deflecting and agitating air currents passing thereover to improve cooling of an individual's head positioned within said helmet.

3. The illuminated bicycle helmet of claim 2, and further comprising a center wind vane extending longitudinally along an exterior surface of said shell for aerodynamically precluding said individual's head from moving laterally relative to an individual's body.

4. The illuminated bicycle helmet of claim 1, wherein said exterior shell is shaped so as to resemble a head of a dragon, with said visor being correspondingly shaped into a face of a dragon.

5. An illuminated bicycle helmet comprising:

a contoured exterior shell for positioning at least partially over a head of an individual, said exterior shell being substantially hemispherically shaped and including a forwardly projecting visor, said visor operating both to shade an individual's eyes during use of said helmet and to protect an individual's face from impact with a ground surface during contact of said helmet therewith, said exterior shell including a lens cavity formed therein, said exterior shell being shaped so as to define a battery compartment for receiving a plurality of batteries therewithin, said exterior shell further being shaped so as to resemble a head of a dragon, with said visor being correspondingly shaped into a face of a dragon;

a battery access door pivotally mounted to said exterior shell and operable to removably capture said batteries within said battery compartment;

a pair of lateral wind deflectors mounted to respectively opposed sides of said exterior shell for deflecting and agitating air currents passing thereover to improve cooling of an individual's head positioned within said helmet;

a center wind vane extending longitudinally along an exterior surface of said shell for aerodynamically precluding said individual's head from moving laterally relative to an individual's body;

an interior pad covering at least a portion of an interior surface of said exterior shell, said interior pad extending partially onto an exterior surface of said shell to define a padded perimeter portion, with said perimeter portion being operable both to pad a perimeter edge of said shell and to removably couple said interior pad within said shell, said perimeter of said exterior shell being formed in such a manner so as to define an enlarged portion which can be snapped into and frictionally retained within a cavity formed within said padded perimeter portion of said interior pad;

strap means for securing said illuminated bicycle helmet to said head of said individual, said strap means comprising a first strap secured to a first lateral edge of said exterior shell; a second strap secured to a second, opposed lateral edge of the shell; a chin pad engagable to a chin of said individual, said second strap extending from said shell to couple with said chin pad; a link strap extending from an opposed side of said chin pad relative to said second strap; a female clip coupled to said link strap; and a male clip adjustably secured to said first strap, said male clip being selectively securable to said female clip;

and, signal light means for alerting surrounding individuals to a presence of said individual wearing said bicycle helmet, said signal light means comprising a light socket extending through said exterior shell; a light bulb received within said light socket; a lens including a cylindrical projection which extends into said lens cavity, said cylindrical projection of said lens including an annular projection received within an annular groove within said lens cavity to frictionally and removably retain said lens relative to said exterior shell; and a switch means electrically coupled to said light socket for selectively coupling said light socket to said plurality of batteries.

* * * * *